United States Patent [19]

Campbell

[11] Patent Number: 4,600,409

[45] **Date of Patent: * Jul. 15, 1986**

[54] QUATERNARY DEPOSIT CONTROL ADDITIVES

[75] Inventor: Curtis B. Campbell, Rodeo, Calif.

[73] Assignee: Chevron Research Company, San Francisco, Calif.

[ * ] Notice: The portion of the term of this patent subsequent to Jan. 14, 2003 has been disclaimed.

[21] Appl. No.: 791,180

[22] Filed: Oct. 25, 1985

Related U.S. Application Data

[63] Continuation of Ser. No. 632,784, Jul. 20, 1984, Pat. No. 4,564,372, which is a continuation-in-part of Ser. No. 518,506, Jul. 29, 1983, abandoned, and a continuation-in-part of Ser. No. 518,505, Jul. 29, 1983, abandoned, which is a continuation-in-part of Ser. No. 510,128, Jun. 30, 1983, abandoned.

[51] Int. Cl.[4] ..... C10L 1/22

[52] U.S. Cl. ..... 44/71; 44/72; 44/75; 252/392; 564/505

[58] Field of Search ..... 44/71, 72, 75; 252/403, 252/405, 392; 564/505; 260/501.15; 560/159; 524/217

[56] References Cited

U.S. PATENT DOCUMENTS

| | | | |
|---|---|---|---|
| 3,366,672 | 1/1968 | Wakeman | 44/71 |
| 3,428,682 | 2/1969 | Egan et al. | 252/353 |
| 3,440,029 | 4/1969 | Little et al. | 44/72 |
| 3,454,625 | 7/1969 | Eiseman | 260/482 |
| 3,468,640 | 9/1969 | Barusch | 44/66 |
| 4,040,798 | 8/1977 | Kuhn et al. | 44/71 |
| 4,160,648 | 7/1979 | Lewis et al. | 44/63 |
| 4,236,020 | 11/1980 | Lewis et al. | 44/63 |
| 4,247,301 | 1/1981 | Honnen | 44/63 |
| 4,261,704 | 4/1981 | Langdor | 44/72 |
| 4,294,714 | 10/1981 | Lewis | 44/71 |

OTHER PUBLICATIONS

The Merck Index, 10th Ed., p. 9022 (1983).

*Primary Examiner*—William R. Dixon, Jr.
*Assistant Examiner*—Margaret B. Medley
*Attorney, Agent, or Firm*—S. R. LaPaglia; R. C. Gaffney; G. F. Swiss

[57] ABSTRACT

A fuel composition is disclosed containing 30 to 10,000 ppm of an additive comprising quaternized polyoxyalkylene amine salts of molecular weight 500 to about 2500, the polyoxyalkylene moiety comprising 1 to 30 oxyalkylene units, the units having 2 to 4 carbon atoms and the amine comprising 1 to 12 amine nitrogen atoms and 2 to 40 carbon atoms and having a connecting moiety linking the polyoxyalkylene moiety to the amine moiety. Also disclosed are lubricating oil compositions containing the additive, concentrates of this additive and the composition of the additive itself.

15 Claims, No Drawings

QUATERNARY DEPOSIT CONTROL ADDITIVES

CROSS REFERENCE TO RELATED APPLICATIONS

This application is a continuation of U.S. Ser. No. 632,784, filed July 20, 1984 now U.S. Pat. No. 4,564,372, which in turn is a continuation-in-part of U.S. Ser. No. 518,506, filed on July 29, 1983, now abandoned, and U.S. Ser. No. 518,505, filed on July 29, 1983, now abandoned, which in turn is a continuation-in-part of U.S. Ser. No. 510,128, filed on June 30, 1983, now abandoned.

BACKGROUND OF THE INVENTION

Field of the Invention

This invention is directed to quaternary salts of various polyether polyamines, to fuel compositions and lubricating oil compositions containing these compounds and to their use as either fuel additives or detergents or dispersancy additives in lubricating oils.

Numerous deposit-forming substances are inherent in hydrocarbon fuels. These substances when used in internal combustion engines tend to form deposits on and around areas of the engine contacted by the fuel. Typical areas commonly and sometimes seriously burdened by the formation of deposits include carburetor ports, the throttle body and venturies, engine intake valves, combustion chamber, etc.

Deposits adversely affect the operation of the vehicle. For example, deposits on the carburetor throttle body and venturies increase the fuel-to-air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction starves the engine of air and fuel and results in a loss of power. Deposits on the valves also increase the probability of valve failure due to burning and improper valve seating. In addition, these deposits may break off and enter the combustion chamber, possibly resulting in mechanical damage to the piston, piston rings, engine head, etc.

The formation of these deposits can be inhibited as well as removed by incorporating an active detergent and/or dispersant into the fuel. These detergents/dispersants function to cleanse these deposit-prone areas of the harmful deposits, thereby enhancing engine performance and longevity. There are numerous detergent-type gasoline additives currently available which, to varying degrees, perform these functions.

Additionally, many corrosion problems are inherent in engine operation, particularly over time. Moisture and oxygen and petroleum fuels in contact with ferrous metals contribute to the formation of corrosion products which may significantly interfere with the smooth operation of a variety of a vehicle's fuel system and engine parts, such as the fuel storage tank, fuel lines and injectors. This corrosion can also be formed or promoted by various other agents including some fuel components, such as acids, and even some deposit control additives. This corrosion, besides interfering with the vehicle's operation which may result in a shortening of the engine life, also contributes to a reduction of the efficiency of the engine. It is therefore very desirable for a fuel composition to possess both deposit control additives which effectively control the deposits in the intake systems and corrosion inhibitors which help prevent corrosive agents from interfering with efficient engine operation. The present invention discloses a new class of compounds which seek to overcome both of these problems.

Likewise, this application also relates to lubricating oil compositions containing quaternary polyether amine additives which contribute dispersancy and detergency to the compositions.

Lubricating oil compositions, particularly for use in internal combustion engines, have long performed many functions other than simply lubricating moving parts. Modern-day, highly compounded lubricating oil compositions provide anti-wear, anti-oxidant, extreme-pressure and anti-rust protection in addition to maintaining the cleanliness of the engine by detergency and dispersancy. Many lubricating oil additives are well-known for accomplishing these functions.

Additionally, many corrosion problems are inherent in engine operation, particularly over time. Moisture and oxygen and petroleum fuels in contact with ferrous metals contribute to the formation of corrosion products which may significantly interfere with the smooth operation of the engine. This corrosion can also be formed or promoted by various other agents including some lubricating oil components, such as acids, and even some dispersant additives. This corrosion, besides interfering with the vehicle's operation which may result in a shortening of the engine life, also contributes to a reduction of the efficiency of the engine. It is therefore very desirable for a lubricating oil composition to possess both dispersant additives and corrosion inhibitors. The present invention discloses a new class of compounds which seek to overcome both of these problems.

Deposit control additives including polyether amines are disclosed in U.S. Pat. No. 3,864,098 and hydrocarbyl polyoxyalkylene polyamines in U.S. Pat. No. 4,247,301. U.S. Pat. No. 4,160,648 discloses deposit control additives comprised of polyoxyalkylene carbamates; U.S. patent application Ser. No. 403,607, filed July 30, 1982, discloses polyether polyamine ethanes as deposit control additives; and U.S. Pat. No. 4,526,587, filed May 31, 1983, discloses methylol polyether amino ethanes as deposit control additives.

Additionally, carboxylic and other acid salts, as well as the quaternary salts of basic nitrogen-containing polymers are known in the art as deposit control and/or carburetor detergent additives in fuel compositions. See, for example, U.S. Pat. No. 3,468,640. These additives are also known to have improved corrosion inhibition properties relative to the pure basic nitrogen-containing polymers.

SUMMARY OF THE INVENTION

Additives are provided which, when added to fuel or used as fuel concentrates, are effective in maintaining the cleanliness of the engine and its intake systems. The additives consist of the quaternary salts of various polyether polyamines soluble in hydrocarbon fuel boiling in the gasoline range. These quaternary salts show enhanced dispersancy and corrosion inhibition and therefore serve well as deposit control and/or carburetor dispersants. The nature of the anion in these various salts has also been found to affect their performance.

When added to lubricating oils, these additives are effective in maintaining the dispersancy of the oil and the efficiency of the engine. The additives consist of the quaternary salts of various polyether polyamines soluble in lubricating oil. These quaternary salts show enhanced dispersancy and corrosion inhibition and therefore serve well as lubricating oil dispersant agents. The nature of the anion in these various salts has also been found to affect their performance.

The quaternary salts of the present invention are comprised of basically three moieties or components: a hydrophobic moiety at one end of the molecule comprising polyoxyalkylene polymer submoieties; a hydrophilic amine moiety at the other end, the basic nitrogen atom of which has been quaternized with an appropriate alkyl halide; and the third moiety, a connecting group serving to unite the hydrophilic and hydrophobic ends of the molecule.

The polyoxyalkylene moiety comprises at least one oxyalkylene unit of from 2 to 4 carbon atoms and may be terminated or "capped" with a hydrocarbyl group. The hydrocarbyl terminating group of the polyoxyalkylene moiety may contain from between 5 to 30 carbon atoms. Preferably, the polyoxyalkylene chain is bonded through a terminal oxygen to the appropriate connecting group which is in turn bonded to an amino nitrogen atom in the amine or polyamine group. The polyamine preferably contains from about 2 to about 12 amine nitrogens and from about 2 to about 40 carbon atoms, with a carbon-nitrogen ratio of between 1:1 and 10:1. At least one nitrogen atom is quaternized with a hydrocarbyl halide. The compounds have a molecular weight in the range of about 500 to about 2500, and preferably from about 800 to about 1500.

The hydrocarbyl halides finding use as the quaternizing agents include alkyl groups containing from 1 to 20 carbon atoms and may be or contain aromatic groups such as phenyl or benzyl groups. The halides of the alkyl halide group ordinarily consist of chloride, bromide and iodide. Certain of the additives of the present invention are believed to be useful as dispersant additives in lubricating oils as well.

DETAILED DESCRIPTION OF THE INVENTION

The present invention herein consists of a fuel additive, a quaternized polyoxyalkylene polyamine or polyether polyamine, and a fuel composition containing a major amount of a liquid hydrocarbon fuel boiling in the gasoline range and from about 30 to about 10,000 ppm of said additive. The quaternized polyether polyamine has a molecular weight of from about 500 to about 2500, and preferably from about 800 to about 1500. The additive consists of three parts or moieties. The first is the polyether or polyoxyalkylene moiety, which may or may not be hydrocarbyl terminated or "capped". The polyether moiety is bound through the second moiety, a connecting group or linkage to the nitrogen atom of the third moiety, the amine, which is quaternized by an appropriate alkyl halide.

As fuel additives, the polyoxyalkylene moiety and the quaternized amino moiety are selected to provide solubility in the fuel composition, deposit control activity, and corrosion inhibition within a vehicle's fuel system and engine. As lubricating oil additives, the moieties are selected to provide solubility in a lubricating oil composition with dispersant activity and corrosion inhibition properties.

Polyoxyalkylene Moiety

The polyoxyalkylene moiety is ordinarily comprised of polyoxyalkylene polymers containing at least one oxyalkylene unit, preferably 1 to 30 units, and more preferably 5 to 30 units, and most preferably 10 to about 25 oxyalkylene units. When polymerized in the polymerization reaction, a single type of alkylene oxide may be employed. Copolymers, however, are equally satisfactory and random copolymers are readily prepared. Blocked copolymers of oxyalkylene units also provide satisfactory polyoxyalkylene polymers for the practice of the present invention.

The polyoxyalkylene moiety may also be terminated or "capped" by a hydrocarbyl terminating group. This terminating group may be comprised of an alkyl group of from 5 to about 30 carbon atoms, an aryl group of from 6 to about 30 carbon atoms, an alkaryl group of from 7 to about 30 carbon atoms, an aralkyl group of from 7 to about 30 carbon atoms, or a methylol-substituted alkyl group of from 5 to about 30 carbon atoms.

The polyoxyalkylene moiety may ordinarily be prepared in a variety of ways, the most common for the practice of the present invention being by the reaction of an appropriate lower alkylene oxide containing from 2 to 4 carbon atoms with an appropriate initiator; for example, chlorohydrin or an alkyl phenol. In the preferred embodiment, ethylene chlorohydrin is used. Copolymers may be readily prepared by contacting the initiator compound with a mixture of alkylene oxides, while the blocked copolymers may be prepared by reacting the initiator first with one alkylene oxide and then another in any order or repetitively under polymerization conditions.

As an example, the polyoxyalkylene moiety derived from an alkyl phenol initiated polymerization detailed above is prepared as an alcohol containing a terminal hydroxyl group. The polyether moiety is then attached through the appropriate connecting group to the polyamine moiety by a variety of ways, one of which includes reacting the hydroxyl group of the polyoxyalkylene unit with phosgene to form a polyoxyalkylene chloroformate and then reacting the polyoxyalkylene chloroformate with an amine. Alternatively, the hydroxyl group may be reacted with epichlorohydrin to give a methylol-substituted ethyl chloride end group. The resulting polyoxyalkylene alkyl chloride is then reacted with an amine or polyamine to produce the composition to be quaternized, resulting in the composition of the present invention.

The Connecting Group

The connecting group joining the polyoxyalkylene moiety with the amine moiety may be any relatively small diradical containing at least one carbon, oxygen, sulfur and/or nitrogen atom, and usually containing up to 12 carbon atoms. The connecting group which results and is used in the present composition is ordinarily a function of the method by which the compositions are formed and/or by which the components of the polyoxyalkylene moiety and the polyamine moiety are joined together. Appropriate connecting groups include:

carbamates $-O-\overset{O}{\overset{\|}{C}}-NH-$;

ethylene $-\overset{Z}{\overset{|}{C}H}-\overset{Z}{\overset{|}{C}H}-$;

oxyethylene $\leftarrow CH_2-CH_2O\rightarrow$;

methylol ethylene $-\overset{CH_2OH}{\overset{|}{C}H}-CH_2-$;

succinates $-O-\overset{O}{\overset{\|}{C}}-CH_2-CH_2-\overset{O}{\overset{\|}{C}}-O-$;

ethers $-O-$;
thioethers $-S-$;

carbonyls $-\overset{O}{\overset{\|}{C}}-$;

carbonates $-O-\overset{O}{\overset{\|}{C}}-O-$;

esters $-\overset{O}{\overset{\|}{C}}-O-$;

amides $-\overset{O}{\overset{\|}{C}}-NZ-$; and methylene $-CHZ-$;

where Z and Z' independently = H, or an alkyl group of from 1 to 2 carbon atoms.

The Amine Moiety

The amine moiety of the quaternized polyether amine is derived from ammonia or, more preferably, from a polyamine having from about 2 to about 12 amine nitrogen atoms and from about 2 to about 40 carbon atoms. The polyamine preferably has a carbon to nitrogen ratio of from about 1:1 to about 10:1. The polyamine may be substituted with a substituent group selected from (A) hydrogen; (B) hydrocarbyl groups from about 1 to about 10 carbon atoms; (C) acyl groups from about 2 to about 10 carbon atoms; and (D) monoketo, monocyano, lower alkyl and lower alkoxy derivtives of (B), (C). "Lower", as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g. aralkyl. The substituted polyamines of the present invention are generally, but not necessarily, N-substituted polyamines. The acyl groups falling within the definition of the aforementioned (C) substituents are such as propionyl, acetyl, etc. The more preferred substituents are hydrogen, $C_1$ to $C_6$ alkyls, and $C_1$-$C_6$ hydroxyalkyls.

The more preferred polyamines finding use within the scope of the present invention are polyalkylene polyamines, including alkylene diamine and substituted polyamines, e.g. alkyl and hydroxyalkyl-substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and include ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g. ethylene diamine, tetraethylenepentamine, etc.

In many instances a single compound will not be used as reactant in the preparation of the compositions of this invention, in particular the polyamine component. That is, mixtures will be used in which one or two compounds will predominate with the average composition indicated.

The Quaternized Composition

The final compositions of the present invention are prepared by the quaternization of the polyether polyamines using alkyl halides. Quaternary ammonium compounds are generally prepared by the reaction of amines with alkyl halides. These compounds have 4 carbon atoms linked directly to a nitrogen atom through covalent bonding. The anion in the original alkylating agent is therefore linked to the nitrogen through an electrovalent bond. The compositions are prepared by reacting the appropriate polyether polyamine with an alkyl halide containing from 1 to 20 carbon atoms. The alkyl halide may also contain aromatics such as benzyl, etc. The halides utilized in the alkyl halides of the present invention ordinarily consist of chloride, bromide and iodide. The anion portion of the quaternized ammonium compounds may also be exchanged for other anions such as acetate, trimethylacetate, alkylphenoxide, or hydroxide. These may be generalized as $C_2$ to $C_{12}$ carboxylate anions, $C_6$ to $C_{30}$ phenoxides, or alkyl-substituted phenoxides. The polyether polyamines are quaternized by standard quaternizing reactions; that is, mixing appropriate amounts of the amine and the alkyl halide and applying heat.

A generalized, preferred formula for the quaternized polyether polyamines finding utility in this invention is as follows:

$$R-O\left(\overset{R^{i}}{\overset{|}{C}H}-\overset{R^{ii}}{\overset{|}{C}H}-O\right)_{n-1}\overset{R^{i}}{\overset{|}{C}H}-\overset{R^{ii}}{\overset{|}{C}H}-X-R^{iii}-\overset{R^{iv}}{\overset{|}{\underset{R^{v}}{\underset{|}{N}}}}{}^{+}-R^{vi}Y^{-}$$

wherein

R = an alkyl group of 5 to 30 carbon atoms, aryl group of 6 to 30 carbon atoms, alkaryl group of 7 to 30 carbon atoms, aralkyl group of 7 to 30 carbon atoms, or methylol-substituted alkyl group of 5 to 30 carbon atoms;

$R^{i}$ and $R^{ii}$ independently = hydrogen, methyl or ethyl;

n = 1 to 30, preferably 10 to 25;

X = the connecting group as defined above;

$R^{iii}$ = a chemical bond, an alkylene or hydroxy-substituted alkylene group of 2 to 12 carbon atoms, or $-NH-CH_2-CH_2-_x$, where x = 1 to 5;

$R^{iv}$ and $R^{v}$ independently = alkyl groups of 1 to 20 carbon atoms, aralkyl group of 7 to 20 carbon atoms, alkaryl group of 7 to 20 carbon atoms, or phenyl;

$R^{vi}$ = alkyl groups of 1 to 20 carbon atoms, aralkyl groups of 7 to 20 carbon atoms, alkaryl groups of 7 to 20 carbon atoms, phenyl, or $$\overset{H}{\leftarrow CH_2CH_2N\rightarrow_x} H,$$

where x = 1 to 5; and

Y = a halide, a $C_2$ to $C_{12}$ carboxylate anion, or a $C_6$ to $C_{30}$ phenoxide or alkyl-substituted phenoxide.

The proper concentration of the additive in fuel necessary in order to achieve the desired deposit control effect or carburetor detergency is dependent upon a variety of factors, including type of fuel used, the presence of other detergents or dispersants, or other additives, etc. Generally, however, and in the preferred embodiment, the range of concentration of the additive in the base fuel is from 30 to 10,000 weight ppm, preferably from 30 to 2,000 weight ppm, and most preferably from 100 to 700 ppm of quaternized polyether polyamine per part of base fuel. If other detergents are present, a lesser amount of quaternized polyether polyamine may be used.

The oils which find use in this invention are oils of lubricating viscosity derived from petroleum or synthetic sources. Oils of lubricating viscosity normally nave viscosities in the range of 35 to 50,000 Saybolt Universal Seconds (SUS) at 37.8° C., and more usually from about 50 to 10,000 SUS at 37.8° C. Examples of such base oils are naphthenic bases; paraffin bases; mixed-base mineral oils; and synthetic oils, for example, alkylene polymers such as polymers of propylene, butylene, etc.; and mixtures thereof.

Usually included in the oils besides the subject additives are such additives as dispersants/detergents, rust inhibitors, anti-oxidants, oiliness agents, foam inhibitors, viscosity index improvers, pour point depressants, etc. Usually, these other additives will be present in amounts of from about 0.5 to 15.0 weight percent of the total composition. Generally, each of the additives will be present in the range from about 0.01 to 5.0 weight percent of the total composition.

It is also contemplated that the quaternized polyether polyamines may be used as concentrates, and could be used as additives to fuels or lubricating oils subsequent to their preparation. In concentrates, the weight percent of these additives will usually range from about 0.3 to 50 weight percent. The concentrate would ordinarily comprise an inert, stable oleophilic, organic solvent and the carrier of said solvent, boiling in the range of from about 65.6° C. to 204.4° C. The concentrate will preferably contain from about 10 to about 50 weight percent of the quaternized polyether polyamine compound.

The following examples are presented to illustrate a specific embodiment of the practice of this invention and should not be interpreted as a limitation upon the scope of that invention.

EXAMPLES

Example 1

Preparation of

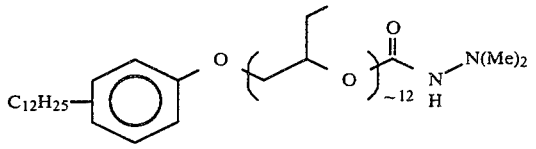

To an ice-cold solution of 55 mls (0.724 moles) dimethyl hydrazine in 100 mls methylene chloride was added a solution of 600 gms (0.360 equivalents)

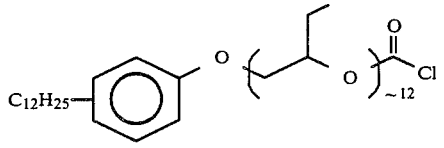

in 600 mls methylene chloride at a rate of approximately 1 drop/second with vigorous stirring under an atmosphere of nitrogen.

After the addition was complete, the reaction was warmed to room temperature and concentrated in vacuo to afford a slurry. This slurry was dissolved in approximately 600 mls of toluene and extracted once with 100 mls of water, once with 100 mls saturated aqueous $NaHCO_3$ and then with water until the washings were neutral (pH paper). The organic layer was dried over anh. $MgSO_4$, filtered and stripped in vacuo to afford 634 gms of a golden oil: Basic nitrogen = 0.67%; total nitrogen = 1.39%; IR ($cm^{-1}$) 1730 (C=O), 3310 (N—H).

Example 2

Preparation of

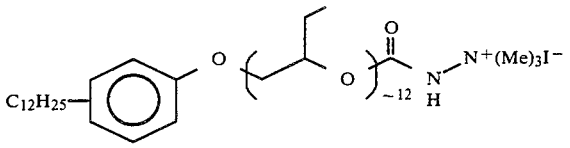

The procedure of M. S. Brown [J. Chem. and Eng. Data, 12, (4) 612 (1967)] was followed. To 570 gms (0.326 equivalents) of the polyether dimethyl hydrazine carbamate prepared in Example 1 was added 41 mls (0.658 moles) of methyl iodide dropwise over approximately 10 minutes under an atmosphere of nitrogen with vigorous stirring. The reaction was stirred at room temperature and monitored by IR until all the starting material had reacted (approximately 18 hours). The reaction was then stripped in vacuo to afford an oil: IR 1750 $cm^{-1}$ (C=O).

Example 3

Preparation of

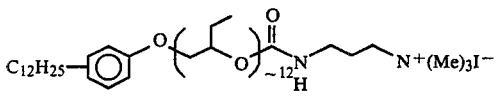

To an ice-cold solution of 300 gms (0.166 moles)

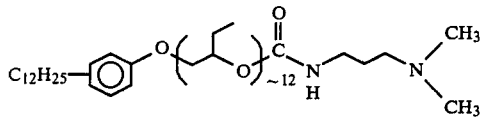

in 50 mls of dimethylformamide and 80 mls tributylamine was added 11 mls (0.166 moles) methyl iodide dropwise with vigorous stirring under an atmosphere of nitrogen. After the addition, the reaction was heated to 60° C. for 1 hour and then allowed to cool to room temperature with stirring overnight. The reaction was then extracted with water until the washings were neutral (pH paper), dried over $Na_2SO_4$ and stripped to afford an oil: Basic nitrogen=0%; IR ($cm^{-1}$) 1710 (carbamate C=O), 3320 (N—H).

Example 4

Preparation of

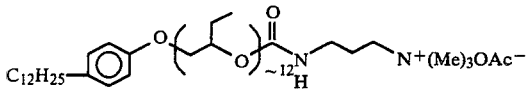

To 50 gms of the material prepared in Example 3 was added 180 mls n-butanol. This solution was extracted nine times with 50 ml portions of a 5 wt. % aqueous sodium acetate solution. The organic layer was then dried over anh. $Na_2SO_4$, filtered and stripped to afford a yellow oil: Basic nitrogen=0.65% IR ($cm^{-1}$) 1575 (carboxylate C=O), 1710 (carbamate C=O), 3250 (N—H).

What is claimed is:

1. A compound suitable for use as a fuel additive having the formula

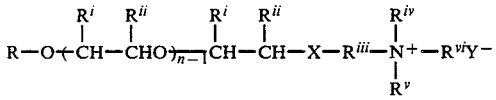

wherein

R=an alkyl group of 5 to 30 carbon atoms, aryl group of 6 to 30 carbon atoms, aralkyl group of 7 to 30 carbon atoms, aralkyl group of 7 to 30 carbon atoms, or methylol-substituted alkyl group of 5 to 30 carbon atoms;

$R^i$ and $R^{ii}$ independently=hydrogen, methyl or ethyl;

n=1 to 30;

X=a connecting group selected from the group consisting of:

carbamates $-O-\overset{O}{\overset{\|}{C}}-NH-$;

-continued ethylene $-\overset{Z}{\overset{|}{C}H}-\overset{Z'}{\overset{|}{C}H}-$;

oxyethylene $-(CH_2-CH_2O)-$;

methylol ethylene $-\overset{CH_2OH}{\overset{|}{C}H}-CH_2-$;

succinates $-O-\overset{O}{\overset{\|}{C}}-CH_2-CH_2-\overset{O}{\overset{\|}{C}}-O$;

ethers $-O-$;

thioethers $-S-$;

carbonyls $-\overset{O}{\overset{\|}{C}}-$;

carbonates $-O-\overset{O}{\overset{\|}{C}}-O-$;

esters $-\overset{O}{\overset{\|}{C}}-O-$;

amides $-\overset{O}{\overset{\|}{C}}-NZ-$; and methylene $-CHZ-$;

where

Z and Z'=H, or an alkyl group of from 1 to 2 carbon atoms;

$R^{iii}$=chemical bond, an alkylene or hydroxy-substituted alkylene group of 2 to 12 carbon atoms, or $-NH-CH_2-CH_2-_x$, where x=1 to 5;

$R^{iv}$ and $R^{v}$ independently=alkyl groups of 1 to 20 carbon atoms, aralkyl group of 7 to 20 carbon atoms, aralkyl group of 7 to 20 carbon atoms, or phenyl;

$R^{vi}$=alkyl groups of 1 to 20 carbon atoms, aralkyl groups of 7 to 20 carbon atoms, aralkyl groups of 7 to 20 carbon atoms, phenyl, or $-NH-CH_2-CH_2-_x$, where x=1 to 5;

Y=a halide selected from the group consisting of chloride, bromide or iodide.

2. A quaternized polyoxyalkylene amine salt of molecular weight from about 500 to about 2500, said polyoxyalkylene moiety comprising 1 to 30 oxyalkylene units selected from oxyalkylene units having 2 to 4 carbon atoms, said amine moiety comprising from 1 to about 12 amine nitrogen atoms and from about 2 to 40 carbon atoms, and further comprising a connecting moiety linking said polyoxyalkylene moiety and said amine moiety and wherein the anion of said quaternized polyoxyalkylene amine salts is a halide selected from the group consisting of chloride, bromide, and iodide.

3. A quaternized polyoxyalkylene amine salt according to claim 2 wherein said amine moiety is a polyamine.

4. A quaternized polyoxyalkylene amine salt according to claim 2 wherein the quaternized amine moiety is quaternized by alkyl halides having from 1 to 20 carbon atoms.

5. A quaternized polyoxyalkylene amine salt according to claim 2 wherein said connecting moiety is selected from the group consisting of carbamate, ethylene, oxyethylene, methylol ethylene, succinate, ether, thioether, carbonyl, carbonate, ester, amide, and methylene groups.

6. A quaternized polyoxyalkylene amine salt according to claim 5 wherein said connecting moiety contains from about 1 to about 12 carbon atoms.

7. A quaternized polyoxyalkylene amine salt according to claim 6 wherein said polyoxyalkylene moiety comprises 10 to about 25 oxyalkylene units.

8. A quaternized polyoxyalkylene amine salt according to claim 7 wherein said amine moiety contains from about 2 to about 12 amine nitrogen atoms and from about 2 to about 24 carbon atoms.

9. A quaternized polyoxyalkylene amine salt according to claim 8 wherein said amine moiety comprises $C_2$ to $C_3$ alkylene polyamines.

10. A quaternized polyoxyalkylene amine salt according to claim 2 wherein said quaternized polyoxyalkylene amine salts have a molecular weight of from 800 to 1500.

11. A trialkyl polyoxyalkylene ammonium salt of molecular weight from about 500 to about 2500, said polyoxyalkylene comprising 1 to 30 oxyalkylene units selected from oxyalkylene units having 2 to 4 carbon atoms, said amine moiety comprising from 1 to about 12 amine nitrogen atoms and from 2 to about 40 carbon atoms, and further comprising a connecting moiety linking said polyoxyalkylene moiety and said amine moiety and wherein the anion of said quaternized polyoxyalkylene amine salts is a halide selected from the group consisting of chloride, bromide, and iodide.

12. A compound claimed in claim 11 wherein the alkyl groups of said trialkyl polyoxyalkylene ammonium salt are selected from the group consisting of alkyl groups of 1 to 20 carbon atoms, aralkyl groups of 7 to 20 carbon atoms, aralkyl groups of 7 to 20 carbon atoms and phenyl.

13. A compound as claimed in claim 12 wherein said trialkyl groups are methyl groups.

14. A fuel concentrate comprising from 90 to 50 percent by weight of an inert, stable, oleophilic organic solvent boiling in the range of from 65.6° C. to 204.4° C. and from 10 to 50 weight percent of a compound of claim 1.

15. A fuel concentrate comprising from 90 to 50 percent by weight of an inert, stable, oleophilic organic solvent boiling in the range of from 65.6° C. to 204.4° C. and from 10 to 50 weight percent of a compound of claim 2.

* * * * *